US006427716B1

(12) United States Patent
Hoeptner, III

(10) Patent No.: US 6,427,716 B1
(45) Date of Patent: Aug. 6, 2002

(54) POSITIVE DISPLACEMENT HYDRANT WITH WATER DISCHARGE PATH FROM RESERVOIR

(76) Inventor: Herbert W. Hoeptner, III, 7796 Oak Springs Cir., Gilroy, CA (US) 95020

( * ) Notice: Subject to any disclaimer, the term of this patent is extended or adjusted under 35 U.S.C. 154(b) by 0 days.

(21) Appl. No.: 09/883,157

(22) Filed: Jun. 18, 2001

(51) Int. Cl.[7] ..... E03B 9/04; E03B 9/14

(52) U.S. Cl. ..... 137/281; 137/216; 137/289; 137/301

(58) Field of Search ..... 137/281, 282, 137/292, 294, 295, 301, 59, 62, 215, 216

(56) References Cited

U.S. PATENT DOCUMENTS 4,096,877 A * 6/1978 Arledge, III ..... 137/281
5,261,441 A * 11/1993 Anderson ..... 137/281
5,553,637 A * 9/1996 Hoeptner, III ..... 137/281
6,047,723 A * 4/2000 Hoeptner, III ..... 137/281
6,085,776 A * 7/2000 Hoeptner, III ..... 137/281

* cited by examiner

*Primary Examiner*—George L. Walton
(74) *Attorney, Agent, or Firm*—William W. Haefliger

(57) ABSTRACT

A hydrant, comprising in combination an upper portion including a handle, a lower portion to be installed at least in part underground, the lower portion including a reservoir and a piston adapted to be displaced in the reservoir in response to handle manipulation, to displace water from a portion of the reservoir, a first conduit communicating with the interior of the reservoir to receive displaced water, the first conduit having an outlet located above ground to freely discharge water received in the conduit from said chamber, when water is displaced from the reservoir.

18 Claims, 4 Drawing Sheets

POSITIVE DISPLACEMENT HYDRANT WITH WATER DISCHARGE PATH FROM RESERVOIR

BACKGROUND OF THE INVENTION

This invention relates generally to freeze resisting valves, and more particularly to valves installable in such relation to the ground as to resist freeze-up in cold weather.

Freezing of water control valves in winter, as for example in remote locations, such as farms, ranches, etc., has been a persistent problem. U.S. Pat. No. 6,047,723 discloses a simple, reliable valve that-does not require heating, as by electricity or other means, and. that will resist, and prevent, freeze-up in normal winter conditions. That valve employs a water reservoir beneath a piston, and water collects in the reservoir. There is need for removal of water from the reservoir, to alleviate stagnant water build-up, and/or to alleviate operational problems.

SUMMARY OF THE INVENTION

It is a major object of the invention to provide an improved hydrant structure, to meet the above need. Basically, the hydrant assembly includes:

a) an upper portion including a handle, b) a lower portion to be installed at least in part underground, c) the lower portion including a reservoir and a piston adapted to be displaced in the reservoir in response to handle manipulation, to displace water from a portion of the reservoir, d) a first conduit communicating with the interior of the reservoir to receive displaced water, e) the first conduit having an outlet located above ground to freely discharge water received in the conduit, when water is displaced from the reservoir.

Accordingly, water in the reservoir can be discharged exteriorly of the hydrant in response to hydrant operation, to prevent stagnant water build-up in the reservoir.

An additional object is to provide a second conduit having an entrance to receive water discharged from the first conduit, the second conduit having an outlet located underground.

A further object is to provide an air gap located between the first conduit outlet and the second conduit entrance. As will be seen, a water collector can be provided at the air gap to collect water discharged from the first conduit, for flow into the second conduit entrance. Also, the air gap is advantageously located above the level of the reservoir, whereby the air gap is. adapted to be located above ground and the reservoir is adapted to be located underground.

It is yet another object to provide the hydrant reservoir installed underground, and the air gap located above ground, the second conduit having an upper portion extending above ground and a lower portion extending underground to discharge water received from the first conduit at underground level.

A yet further object is to provide the first conduit to have upward extension within the second conduit, at a location proximate the first conduit outlet.

The invention also contemplates a hydrant installation method which includes:

locating the reservoir underground, and locating the air gap above ground.

These and other objects and advantages of the invention, as well as the details of an illustrative embodiment, will be more fully understood from the following specification and drawings, in which:

DRAWING DESCRIPTION

DETAILED DESCRIPTION

Figure 1:
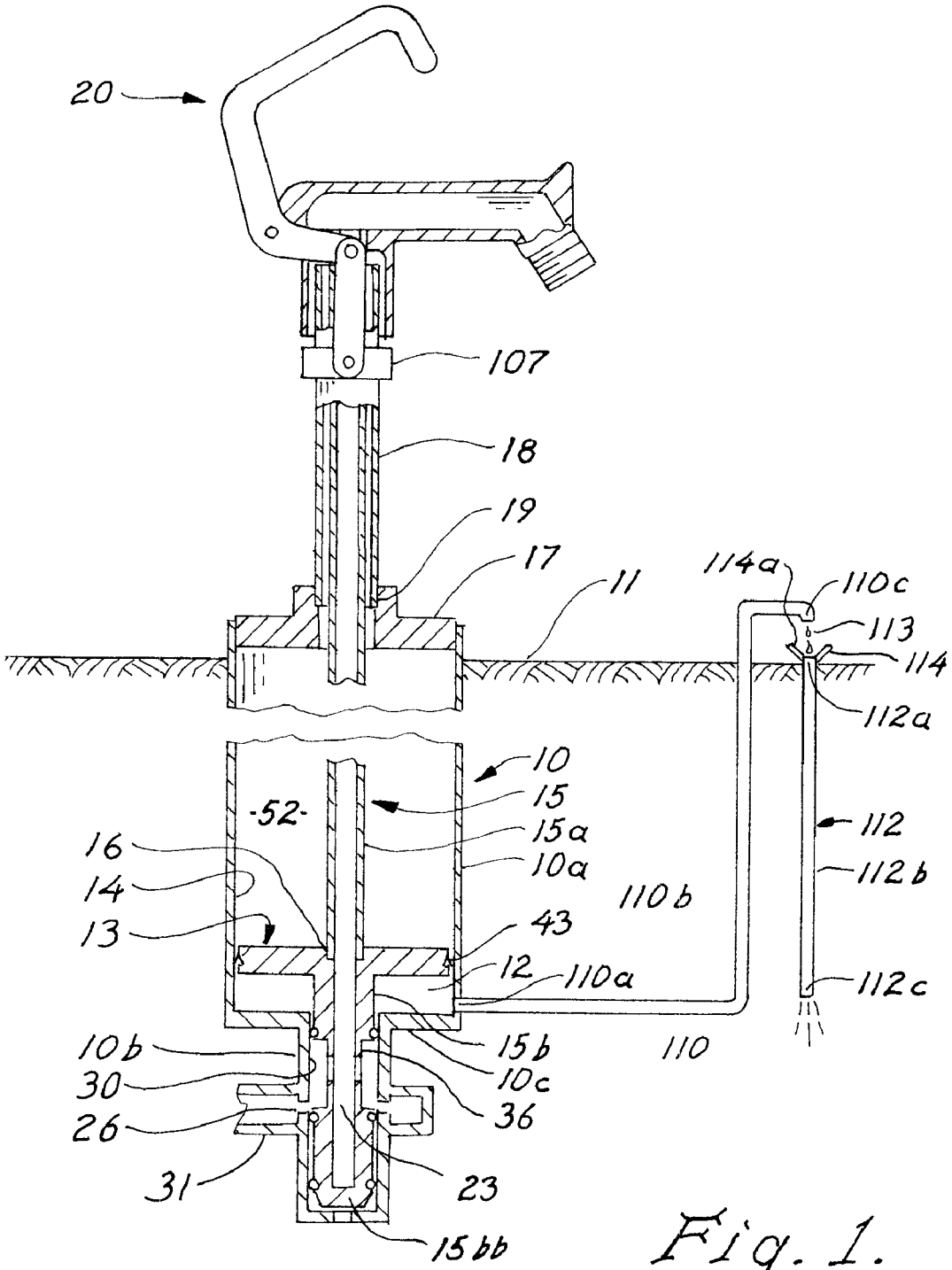
FIG. 1 is a vertical section showing one preferred form of apparatus embodying the invention, and in piston down position.

In the drawings, the vertically elongated, hollow body 10 may be cylindrical, as shown. It is adapted to be installed underground, below ground surface level 11. Heat from the underground formation is conducted to and into the cylindrical body 10, as via its side wall 10*a* and bottom wall 10*c*, which may be metallic. Accordingly, water stored in a reservoir 12 in the lower body does not freeze, despite freezing conditions at and above ground surface level 11.

A piston 13 is shown as received in a bore 14 defined by body 10, to be movable up and down; and it will be understood that as the piston moves downwardly in FIG. 1, water stored in the reservoir 12 is displaced through porting 110*a* into and upwardly within conduit 110.

As shown, lower portion 15*b* may be integral with the piston; and upper portion 15*a* may comprise a tube connected to the piston at 16. Tube 15*a* extends upwardly through a closure 17 closing the upper end of the cylinder 10, and also within a pipe 18 attached to the closure at 19, and extending upwardly to an above ground location, as at 18*a*. Tube 15*a* projects upwardly beyond the upper end of pipe 18 and is movable up and down by an actuator 20, for stroking the piston 13 up and down. Fitting 100, connected to the top of tube 15*a*, delivers water at outlet 101, as the tube 15*a* is moved downwardly.

Supply means is provided to deliver water from a below-ground source into the tubular means for flow upwardly therein and delivery above the piston and cylinder when the piston is in a down position relative to the cylinder. Such supply means typically has communication with the interior 23 of the tubular means lower portion 15*b* in piston down position (see FIGS. 1 and 3) and is blanked against said communication in piston up position (see FIG. 2). Note, for example, the side wall port 26 in the lower tubular extent 10*b* integral with cylinder 10, and which receives the tubular means lower portion 15*b* projecting downwardly as shown to move within a bore 30 defined by 10*b*.

An underground water supply pipe appears at 31 and is in communication with port 26. Lower portion 15*b* of the tubular means 15 has a closed lower end at 15*bb*. Lower tubular extent 10*b* may have a drain opening at 32 in its bottom wall 10*bb*.

Figure 2:
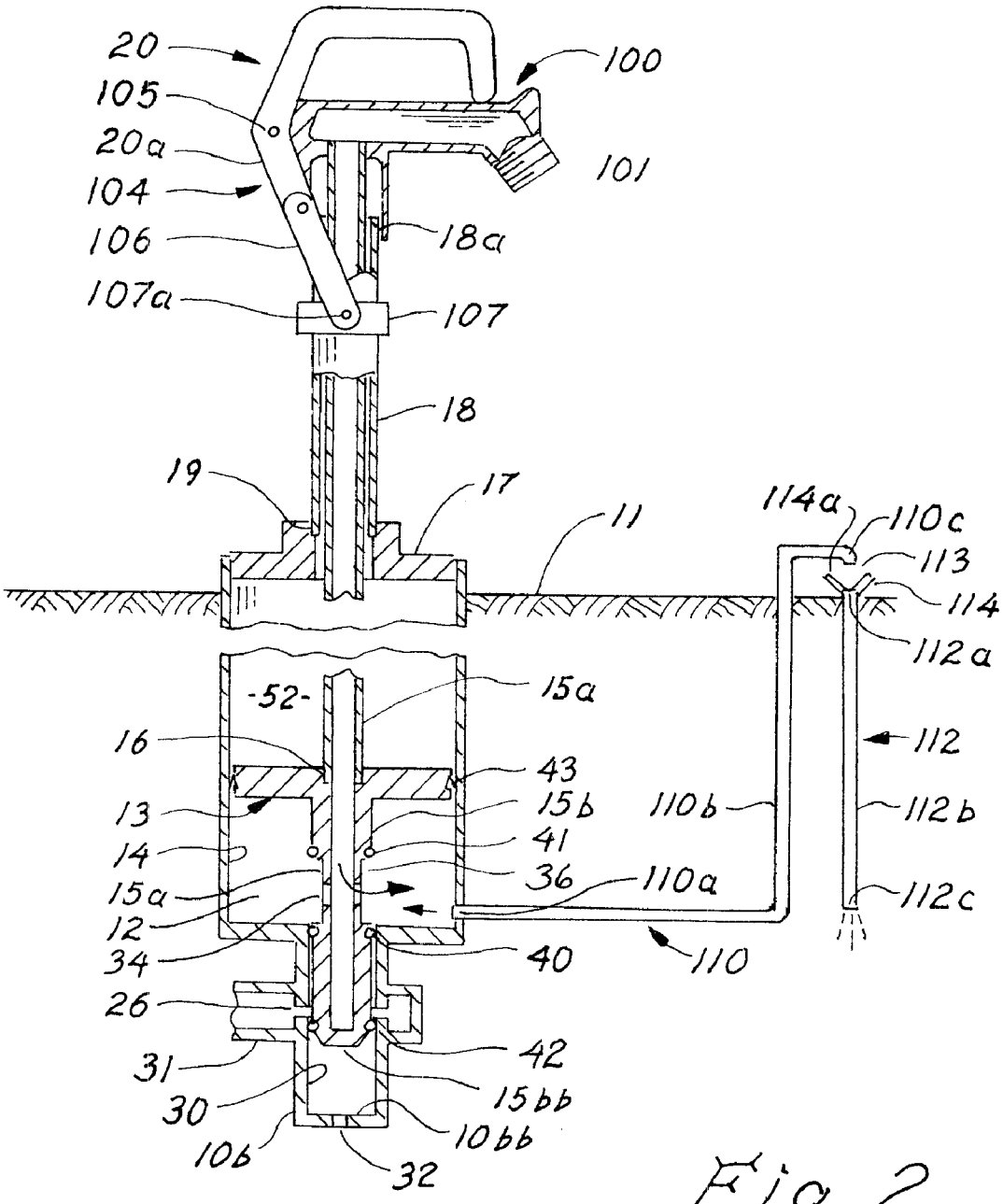
FIG. 2 is a view like FIG. 1 but showing the apparatus in piston up position.

Porting is provided in the tubular means lower portion 15*b*, as at 34, to drain water from within the tubular means into a reservoir within the cylinder below the piston, when the piston is moved to an up position relative to the cylinder. Accordingly, any water remaining above ground level in the upper tubular portion 15*a* drains through porting 34, and into the underground reservoir 12 as indicated in FIG. 2, to prevent freezing of water in 15*a*. The hydrant is, therefore, usable in winter as well as other seasons, no water remaining above ground to freeze in 15*a* above ground.

Seals 40 and 41 are carried by 15*b* above and below clearance 36, to engage bore 30, and a bottom seal 42 below the level of porting 26 also engages bore 30, as in FIG. 2. A piston seal appears at 43.

Actuator 20 has pivot connection at 105 to the fitting 100; and a link 106 pivotally connects the lower arm 20*a* of the actuator to a sleeve 107 attached by set screw 107*a* to fixed pipe 18 when set screw 107*a* is released, pull up of 100 pulls 107 off 18, after 17 is removed from 10. As actuator 20 is swung counterclockwise, the tubular means 15 and piston 13 are moved downwardly to enable hydrant water flow; and as 20 is swung clockwise, 15 and 13 move upwardly to stop such flow.

Figure 3:
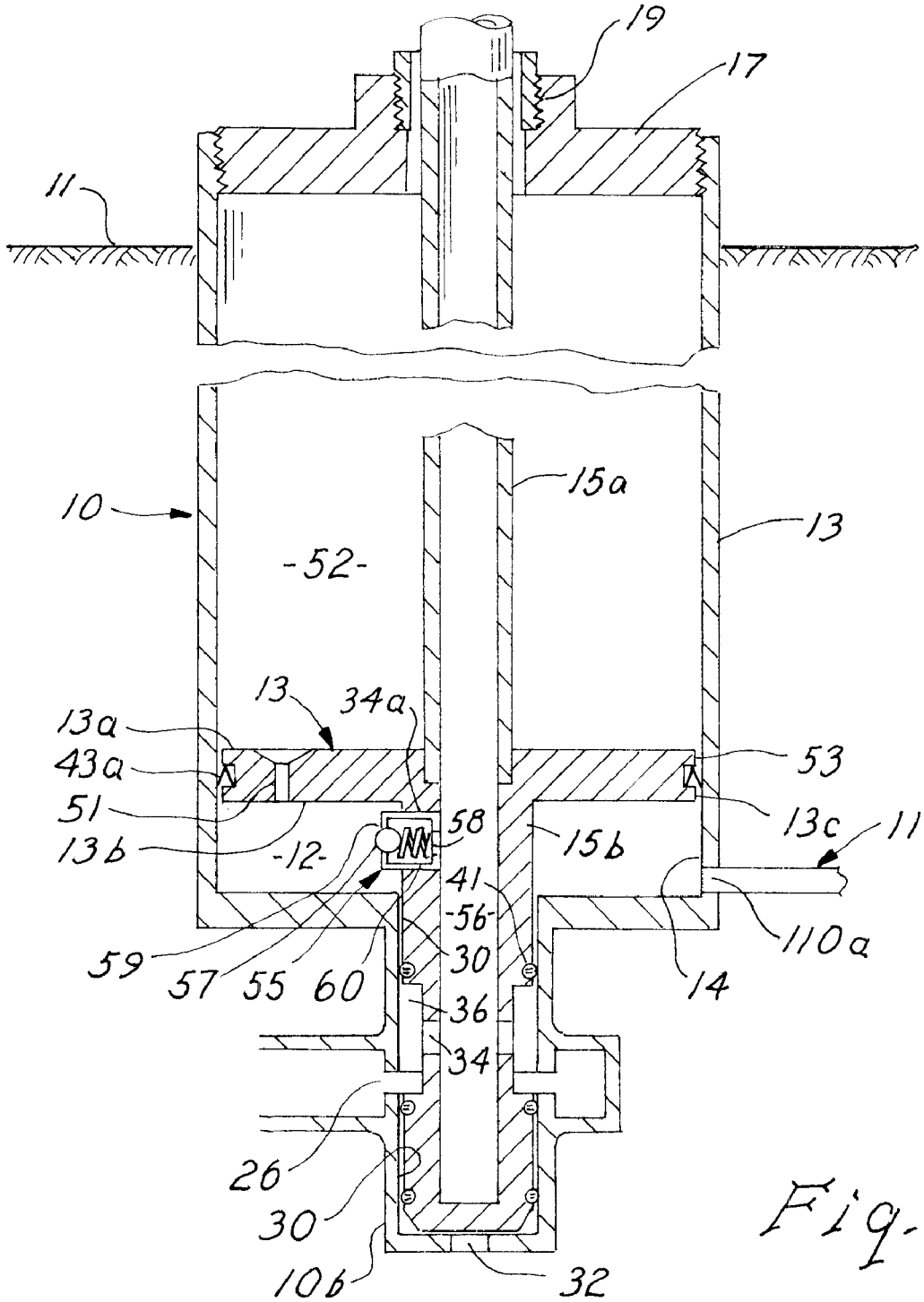
FIG. 3 is an enlarged vertical section showing details of the lower underground portion of the modified apparatus in piston down position.

FIG. 3 shows one modified form of the FIG. 1 and FIG. 2 apparatus, and wherein corresponding elements bear the same identifying numerals. A through port 51 through the piston 13, between its upper and lower surfaces 13*a* and 13*b*, allows some water under pressure to flow upwardly from reservoir 12 to the chamber 52 above the piston, during the piston down-stroke. Also, port 51 allows water to drain from chamber 52 into the reservoir, at times when the piston is in the up-position, as seen in FIG. 2, to prevent water freezing in chamber 52.

In another form, a slight, annular clearance 53 between the piston periphery 13*a* and bore 14 allows air to pass between 52 and 12 during the piston up-stroke. Note the chevron seal 43*a*, which accommodates such air passage, but blocks water flow upwardly through the clearance, during the piston down-stroke.

A check valve unit 55 in that other form is then carried within a port 34*a* in portion 15*b* of the tubular means, immediately below the piston. That unit 55 allows water to flow from the reservoir 12 into the bore 56 of the tubing portion 15*b* during the down-stroking of the piston and particularly after seal 41 travels downward in engagement with bore 30; however, it blocks reverse water flow from tubing bore 56 into the reservoir 12. The unit includes a ball check 57 resiliently urged by spring 58 against a seat 59 in a tubular insert 60. That insert is carried in port 34*a*, as shown. When the port 51 is employed, the check valve unit 55 need not be used, and vice versa.

In piston up-position, water can flow from pipe 15*a* to the reservoir, via elongated clearance at 36.

The present invention is particularly directed to provision of a discharge path from the reservoir 12, to alleviate or reduce stagnant water collection in the reservoir, and to provide an additional discharge path of water from the reservoir. As will be seen, a first conduit, as for example is seen at 110, is provided to be in communication with the interior of the reservoir to receive piston displaced water; and that conduit is provided with an outlet located above ground to freely discharge water received in the conduit from said reservoir, when water is displaced from the reservoir.

In the example of FIG. 1, the conduit extends upwardly at 110*b*, from an entrance end at 110*a* proximate the reservoir, and to a discharge end 110*c*, forming the outlet. The latter is typically located above ground so that water is freely discharged to ambient air pressure, at the hydrant exterior.

A second conduit may be provided as at 112 to have an entrance at 112*a* for receiving water discharged from the first conduit, the second conduit having an outlet 112*c* located underground, for drainage of reservoir water into non-frozen soil. The second conduit has downward extent at 112*b*, between 112*a* and 112*c*.

Preferably, there is an air gap located or formed, as at 113 between the first conduit outlet 110*c* and the second conduit entrance 112*a*, to assure ambient air pressure conditions at outlet 110*c*. A water collector may be provided at the air gap to collect water discharged from the first conduit, for flow into said second conduit entrance. One such collector taken the form of a pan or funnel 114 extending about the entrance 112*a*, and carried by the second conduit. The illustrated pan upper surface 114*a* is downwardly convergent to guide water flow into entrance 112*a*. The air gap 113 is preferably located above ground, as shown. An upper portion of 112*b* projects above ground, and the lower portion of 112*b* is located underground. Outlet 112*c* is typically located at a level at or below the reservoir level.

Figure 4:
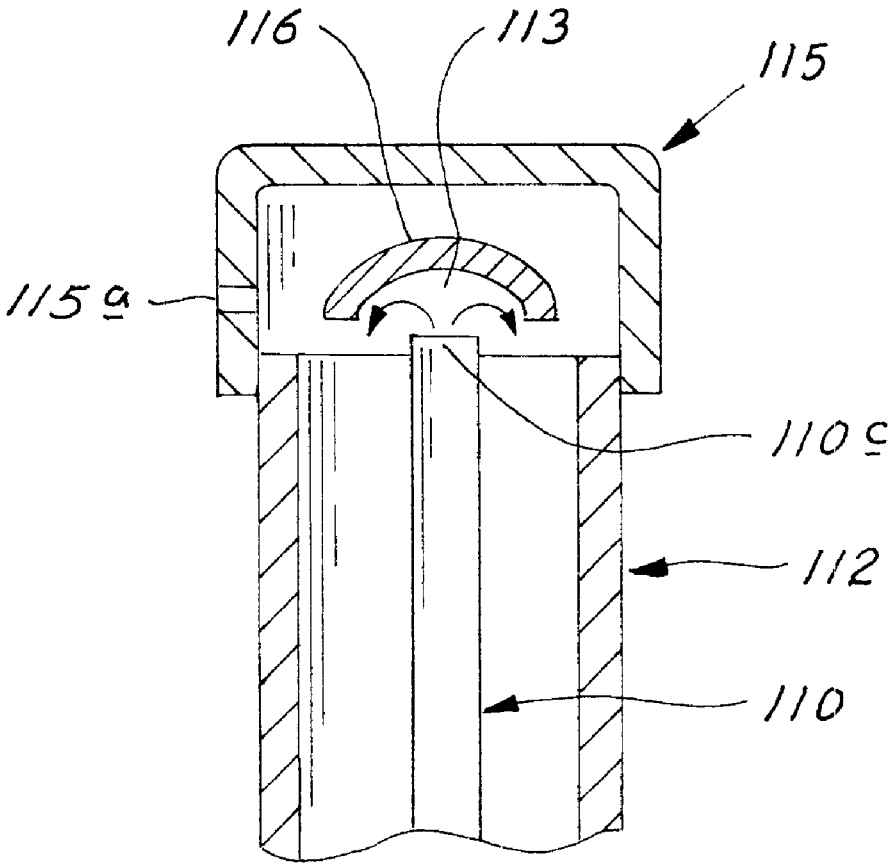
FIG. 4 is an enlarged section showing a modified discharge path from the reservoir.

FIG. 4 shows the upper portion of conduit 110 extending protectively within the upper portion of conduit 112; and a cap is provided at 115 to extend over the air gap 113. The cap is carried by the second conduit, as shown, and may be ported at 115*a* to assure that the air pressure at gap 113 is the same as external ambient pressure conditions. A deflector 116 extends over 110*c* to deflect the flow downwardly into conduit 112.

FIG. 2 also shows water draining back into the reservoir 12 as during upward movement of the piston 13.

I claim:

1. A hydrant, comprising in combination:

a) an upper portion including a handle, b) a lower portion to be installed at least in part underground, c) said lower portion including a reservoir and a piston adapted to be displaced downwardly in said reservoir in response to handle manipulation, to displace water from a portion of the reservoir, d) a first conduit communicating with the interior of the reservoir to receive displaced water, e) said first conduit having an outlet located above ground to freely discharge water received in the conduit from said chamber, when water is displaced from the reservoir, f) and including a stem operatively connected to the handle and to the piston to displace the piston downwardly when the handle is moved in one direction, and to displace the piston upwardly when the handle is moved in another direction.

2. The combination of claim 1 including a second conduit having an entrance to receive water discharged from the first conduit, the second conduit having an outlet located underground.

3. A hydrant, comprising in combination:

a) an upper portion including a handle, b) a lower portion to be installed at least in part underground, c) said lower portion including a reservoir and a piston adapted to be displaced downwardly in said reservoir in response to handle manipulation, to displace water from a portion of the reservoir, d) a first conduit communicating with the interior of the reservoir to receive displaced water, e) said first conduit having an outlet located above ground to freely discharge water received in the conduit from said chamber, when water is displaced from the reservoir, f) there being a second conduit having an entrance to receive water discharged from the first conduit, the second conduit having an outlet located underground, g) and wherein there is an air gap or backflow preventer located between the first conduit inlet and the second conduit entrance.

4. The combination of claim 3 including a water collector at the air gap to collect water discharged from the first conduit, for flow into said second conduit entrance.

5. The combination of claim 3 including a stem operatively connected to the handle and to the piston to displace the piston downwardly when the handle is moved in one direction, and to displace the piston upwardly when the handle is moved in another direction.

6. The combination of claim 4 wherein said air gap is located above the level of said reservoir, whereby said air gap is adapted to be located above ground and said reservoir is adapted to be located underground.

7. The combination of claim 6 wherein said hydrant reservoir is installed underground, and said air gap is located above ground, said second conduit having an upper portion extending above ground and a lower portion extending underground to discharge water received from the first conduit at underground level.

8. The combination of claim 7 wherein said second conduit outlet is located below the level of said reservoir.

9. A hydrant, comprising in combination:

a) an upper portion including a handle, b) a lower portion to be installed at least in part underground, c) said lower portion including a reservoir and a piston adapted to be displaced downwardly in said reservoir in response to handle manipulation, to displace water from a portion of the reservoir, d) a first conduit communicating with the interior of the reservoir to receive displaced water, e) said first conduit having an outlet located above ground to freely discharge water received in the conduit from said chamber, when water is displaced from the reservoir, f) and including a water receiver below said reservoir to receive water form an underground inlet, for flow into said reservoir interior, in response to manipulation of the handle.

10. The combination of claim 9 wherein said receiver includes a pipe having a side entrance to receive water for flow into the pipe, and a plunger movable in the pipe to displace water via the pipe to said reservoir interior.

11. A hydrant, comprising in combination:

a) an upper portion including a handle, b) a lower portion to be installed at least in part underground, c) said lower portion including a reservoir and a piston adapted to be displaced downwardly in said reservoir in response to handle manipulation, to displace water from a portion of the reservoir, d) a first conduit communicating with the interior of the reservoir to receive displaced water, e) said first conduit having an outlet located above ground to freely discharge water received in the conduit from said chamber, when water is displaced from the reservoir, f) a second conduit having an entrance to receive water discharged from the first conduit, the second conduit having an outlet located underground, g) and wherein said second conduit outlet is located below the level of said reservoir.

12. A hydrant, comprising in combination:

a) an upper portion including a handle, b) a lower portion to be installed at least in part underground, c) said lower portion including a reservoir and a piston adapted to be displaced downwardly in said reservoir in response to handle manipulation, to displace water from a portion of the reservoir, d) a first conduit communicating with the interior of the reservoir to receive displaced water, e) said first conduit having an outlet located above ground to freely discharge water received in the conduit from said chamber, when water is displaced from the reservoir, f) a second conduit having an entrance to receive water discharged from the first conduit, the second conduit having an outlet located underground, h) and wherein said first conduit extends upwardly within the second conduit at a location proximate said first conduit outlet.

13. The combination of claim 12 wherein said second conduit entrance opens upwardly.

14. A hydrant, comprising in combination:

a) an upper portion including a handle, b) a lower portion to be installed at least in part underground, c) said lower portion including a reservoir and a piston adapted to be displaced downwardly in said reservoir in response to handle manipulation, to displace water from a portion of the reservoir, d) a first conduit communicating with the interior of the reservoir to receive displaced water, e) said first conduit having an outlet located above ground to freely discharge water received in the conduit from said chamber, when water is displaced from the reservoir, f) a second conduit having an entrance to receive water discharged form the first conduit, the second conduit having an outlet located underground, g) and wherein said second conduit entrance opens upwardly.

15. The method of operation of a hydrant that comprises:

a) an upper portion including a handle, b) a lower portion to be installed at least in part underground, c) said lower portion including a reservoir and a piston adapted to be displaced downwardly in said reservoir in response to handle manipulation, to displace water from a portion of the reservoir, d) a first conduit communicating with the interior of the reservoir to receive displaced water, e) said first conduit having an air gap or back flow preventer outlet located above ground to freely discharge water received in the conduit from said chamber, when water is displaced from the reservoir, said method including f) locating said reservoir underground, and g) locating said air gap above ground.

h) and providing a stem operatively connected to the handle and to the piston to displace the piston downwardly when the handle is moved in one direction, and to displace the piston upwardly when the handle is moved in another direction.

16. The method of operation of a hydrant that comprises:

a) an upper portion including a handle, b) a lower portion to be installed at least in part underground, c) said lower portion including a reservoir and a piston adapted to be displaced downwardly in said reservoir in response to handle manipulation, to displace water from a portion of the reservoir, d) a first conduit communicating with the interior of the reservoir to receive displaced water, e) said first conduit having an air gap outlet located above ground to freely discharge water received in the conduit from said chamber, when water is displaced from the reservoir, said method including f) locating said reservoir underground, and g) locating said air gap above ground, h) and including providing a second conduit having an entrance to receive water discharged from the first conduit, the second conduit having an outlet located underground.

17. The method of claim 16 including providing a water collector at the air gap to collect water discharged from the first conduit, for flow into said second conduit entrance, and operating the hydrant to discharge water from said reservoir into said collector.

18. In a yard hydrant, the combination comprising:

a) a cylinder, and a piston movable up and down in the cylinder in association with water flow into and out of a reservoir in the cylinder, b) tubular means associated with the piston and extending upwardly from the piston and downwardly from the piston, and movable therewith, c) supply means to deliver water from a source into the tubular means for flow upwardly therein and delivery above the piston and cylinder when the piston is in a first position relative to the cylinder, d) there being porting carried by said tubular means to drain water into the reservoir within the cylinder below the piston, when the piston is moved to a second position relative to the cylinder, e) an actuator above the piston and cylinder to effect displacement of the piston and between said positions, f) a first conduit communicating with the interior of the reservoir to receive displaced water, g) said first conduit having an outlet located above ground to freely discharge water received in the conduit from said chamber, when water is displaced from the reservoir.

* * * * *

UNITED STATES PATENT AND TRADEMARK OFFICE

CERTIFICATE OF CORRECTION

PATENT NO. : 6,427,716 B1
DATED : August 6, 2002
INVENTOR(S) : Herbert W. Hoeptner, III It is certified that error appears in the above-identified patent and that said Letters Patent is hereby corrected as shown below:

Column 8,
Line 23, add, -- h) a handle, and said actuator including a stem operatively connected to the handle and to the piston to displace the piston downwardly when the handle is moved in one direction, and to displace the piston upwardly when the handle is moved in another direction. --

Signed and Sealed this

Fourth Day of November, 2003

JAMES E. ROGAN
*Director of the United States Patent and Trademark Office*